United States Patent [19]

Price

[11] Patent Number: 4,814,955

[45] Date of Patent: Mar. 21, 1989

[54] SWIVEL DEVICE FOR MOUNTING A SPOTLIGHT

[75] Inventor: Edison A. Price, New York, N.Y.

[73] Assignee: Edison Price Incorporated, New York, N.Y.

[21] Appl. No.: 40,492

[22] Filed: Apr. 20, 1987

[51] Int. Cl.[4] ..... F21V 21/28

[52] U.S. Cl. ..... 362/275; 362/287; 362/419; 362/427

[58] Field of Search ..... 362/275, 285, 287, 371, 362/419, 427; 248/282

[56] References Cited

U.S. PATENT DOCUMENTS

| | | | |
|---|---|---|---|
| 980,580, | 1/1911 | Williams | 362/419 |
| 1,137,333 | 4/1915 | Klorer | 362/287 |
| 2,048,313 | 7/1936 | Adolfson | 248/282 |
| 3,240,925 | 3/1966 | Paschke et al. | 362/275 |
| 3,604,923 | 9/1971 | Moffatt | 362/427 |
| 4,381,538 | 4/1983 | Warshawsky | 362/287 |
| 4,390,933 | 6/1983 | Warshawsky | 362/285 |
| 4,449,170 | 5/1984 | Warshawsky | 362/419 |
| 4,449,171 | 5/1984 | Warshawsky | 362/419 |

*Primary Examiner*—Ira S. Lazarus
*Assistant Examiner*—Sue Hagarman
*Attorney, Agent, or Firm*—Brumbaugh, Graves, Donohue & Raymond

[57] ABSTRACT

A swivel device for mounting a spotlight comprises vertical means for adjustable rotation of the spotlight around a vertical axis over a maximum arc of more than 360° without twisting damage to electrical wires passing through an interior portion of the swivel device, and horizontal means for adjustable rotation of the spotlight around a horizontal axis. The swivel device is extremely compact and very neat and simple in appearance.

7 Claims, 4 Drawing Sheets

SWIVEL DEVICE FOR MOUNTING A SPOTLIGHT

BACKGROUND OF THE INVENTION

The present invention relates to a swivel device for mounting a spotlight.

There are a variety of swivel devices known heretofore for mounting a spotlight. Such devices generally permit adjustable rotation of the spotlight around both horizontal and vertical axes. However, horizontal rotation around the vertical axis is limited to an arc of less than 360° to prevent twisting damage to electrical wires passing through an interior portion of the swivel device.

The means that are generally employed on such swivel devices to so limit rotation are two fingers that protrude from two adjacent parts which rotate in relation to each other on a common axis when the spotlight is swiveled horizontally. These projecting fingers are configured to engage each other to limit said rotation. The thicker they are in relation to their distance from the axis of rotation the more they will limit rotation to less than 360°. Therefore very compact swivel devices, which have such protruding fingers of sufficient strength to limit rotation without breaking off when they are forced against each other, will often in the prior practice be found to limit the rotation to an arc of no more than 300°. This leaves a "dead" arc of 60° through which the spotlight cannot be directed, and consequently it is impossible to light an object in the area covered by this "dead" arc.

Many swivel devices also have a complex and unsightly appearance, at times with obtrusive locking means such as thumb-screws or articulated knobs. Another class of swivel device relies on spring tension for a locking means, and often this tension is either too great to permit convenient angular aiming adjustment, or too little to provide a secure retention at the adjusted position.

SUMMARY OF THE INVENTION

It is, therefore, the principal object of the present invention to provide a swivel device for mounting a spotlight which not only permits adjustable rotation of the spotlight around a horizontal axis, but which also quite significantly permits adjustable rotation of the spotlight around a vertical axis over a maximum arc of more than 360° without twisting damage to the electrical wires passing through an interior portion of the swivel device.

Another object of the present invention is to provide such a swivel device that is also extremely compact and very neat and simple in appearance.

Another object of the present invention is to provide such a swivel device that looks attractively like two plain intersecting rods, with a smaller horizontal rod passing through a somewhat larger vertical rod, with no visible hint at the distance from which the device is normally observed, that the device is indeed a functional omni-directional swivel with a more than 360° rotation stop around a vertical axis and angular adjustment locking means.

A further object of the present invention is to provide such a swivel device having a positive locking means to secure the swivel device at the angles to which it has been adjusted with no visible hint that such locking means exist.

Yet another object of the present invention is to provide such a swivel device wherein these locking means have a logical and functional relation to the swivel rotations which they control.

A further object of the present invention is to provide such a swivel device wherein the locking means are in the form of two knobs, one of which lies on the horizontal axis of the spotlight mounting stem and is visually a continuation of that stem, and the other of which lies on the vertical axis at the supporting stem, and is visually a continuation of that stem.

A still further object of the present invention is to provide such a swivel device wherein the locking means consist of two knobs such that the locking action is accomplished by rotating these knobs in the same axes of rotation as the axes of rotation of the elements which they serve to secure.

The swivel device of the present invention for mounting a spotlight comprises vertical means for adjustable rotation of the spotlight around a vertical axis over a maximum arc of more than 360° without twisting damage to electrical wires passing through an interior portion of the swivel device, and horizontal means for adjustable rotation of the spotlight around a horizontal axis.

The above-mentioned vertical means comprise a vertical tubular stem;

a tubular adaptor beneath and tightly threaded onto the stem, the adaptor having a rotation stop pin extending into an interior of the adaptor;

a rotatable tubular bushing beneath both the stem and the adaptor;

a rotatable tubular swivel shaft inside both the adaptor and the bushing and having an upwardly extending prong engageable with the rotation stop pin of the adaptor upon rotation of the swivel shaft; and a vertical rotatable knob threaded to the swivel shaft;

said vertical means having a common vertical axis.

The above-mentioned horizontal means comprise a horizontal rotatable knob having an affixed horizontal rod, the rod passing freely through and rotatable in diametrically opposed holes of the bushing and aligned diametrically opposed slots of the swivel shaft;

a horizontal stem having an end threaded to the rod affixed to the horizontal knob; and a mounting ring for the spotlight affixed to another end of the horizontal stem;

said horizontal rotatable knob and horizontal stem having a common horizontal axis.

DETAILED DESCRIPTION OF THE INVENTION

Figure 1A:
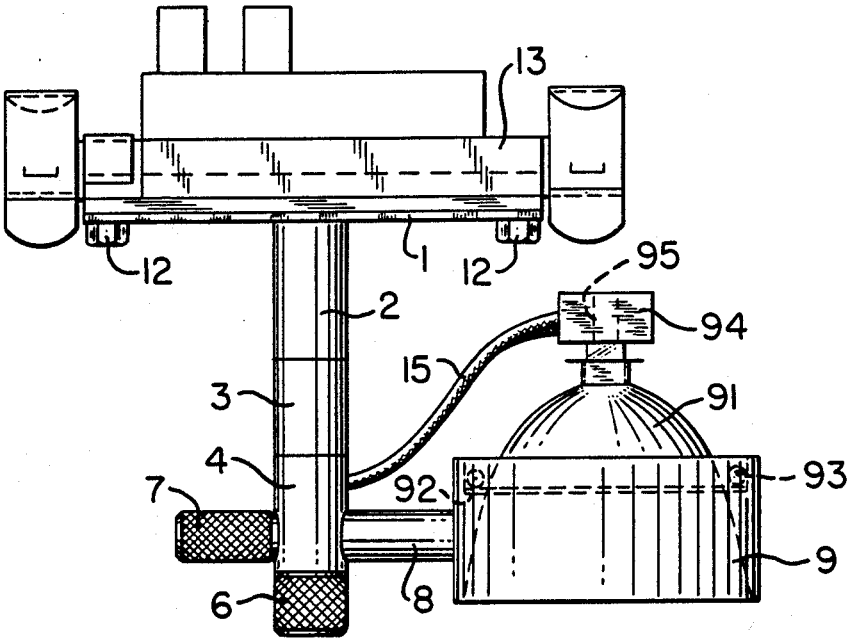
FIG. 1A is a side elevational view of the swivel device of the invention and FIG. 1B is a bottom plan view thereof.

The invention is described in detail below as illustrated by FIGS. 1–8 of the drawing.

The swivel device of the invention for mounting a spotlight comprises the following principal members: an upper horizontal bracket 1, a vertical tubular stem 2, a tubular adaptor 3, a rotatable tubular bushing 4, a rotatable tubular swivel shaft 5, a vertical rotatable knob 6, a horizontal rotatable knob 7, a horizontal stem 8 and a mounting ring 9 for the spotlight 91.

Figure 1B:
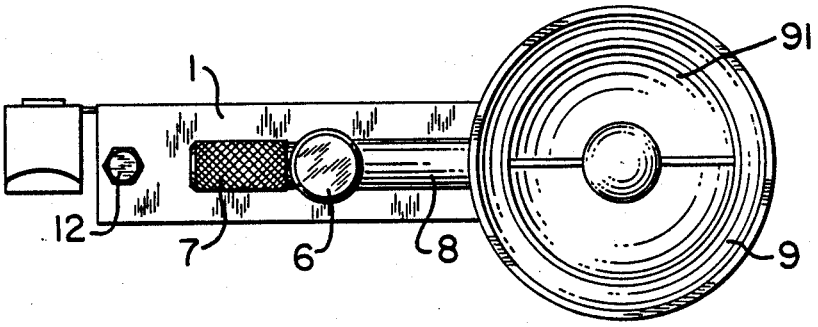
Figure 2:
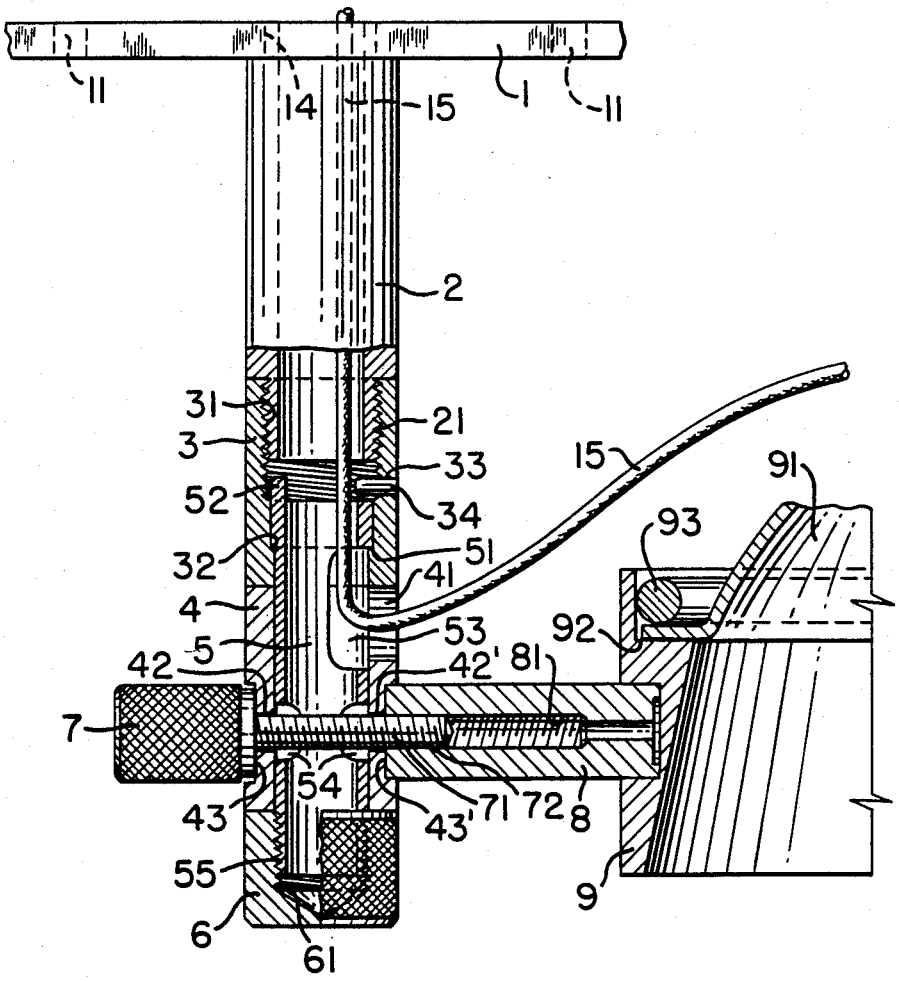
FIG. 2 is an enlarged side elevational view, partly in cross section, of the swivel device of the invention.

As shown in FIGS. 1A, 1B and 2, the upper horizontal bracket 1 has two outward holes 11 therein for the passage of bolts 12 therethrough for attachment of the swivel device to a source of electricity, such as a low voltage track 13. The bracket 1 also has a central hole 14 for passage of the electrical wires 15 therethrough.

Figure 3:
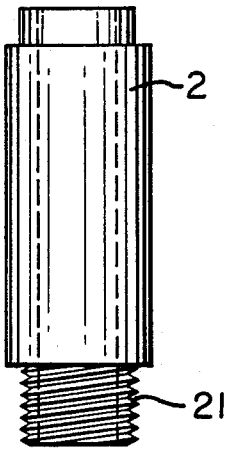
FIG. 3 is a elevational view of the vertical tubular stem of the swivel device of the invention.
Figure 4:
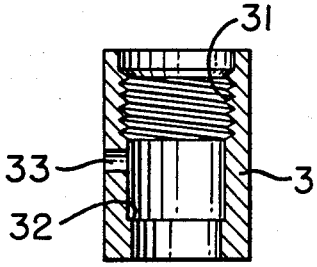
FIG. 4 is an elevational cross section view of the tubular adaptor of the swivel device of the invention.
Figure 5B:
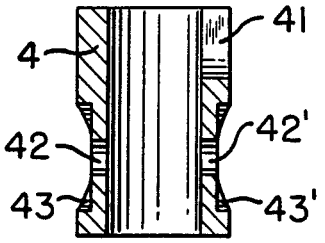
FIG. 5A is an elevational view and FIG. 5B is a cross sectional view taken on section line V—V in FIG. 5A of the rotatable tubular bushing of the swivel device of the invention.
Figure 5A:
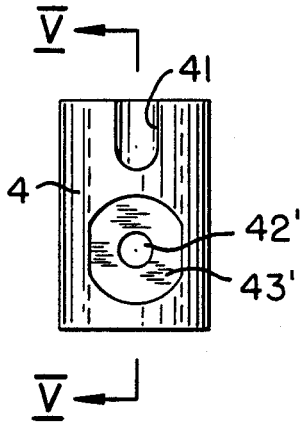
Figure 6C:
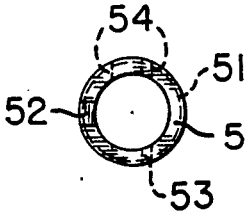
FIG. 6C is a top plan view thereof.
Figure 6A:
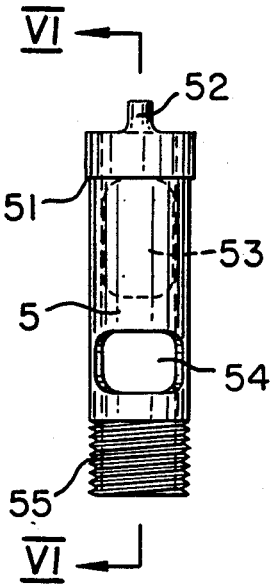
FIG. 6A is an elevational view of the rotatable tubular swivel shaft of the swivel device of the invention.
Figure 6B:
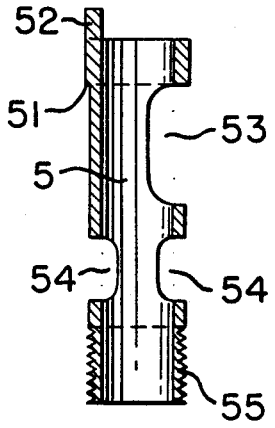
FIG. 6B is a cross sectional view thereof taken on section line VI—VI in FIG. 6A
Figure 7:
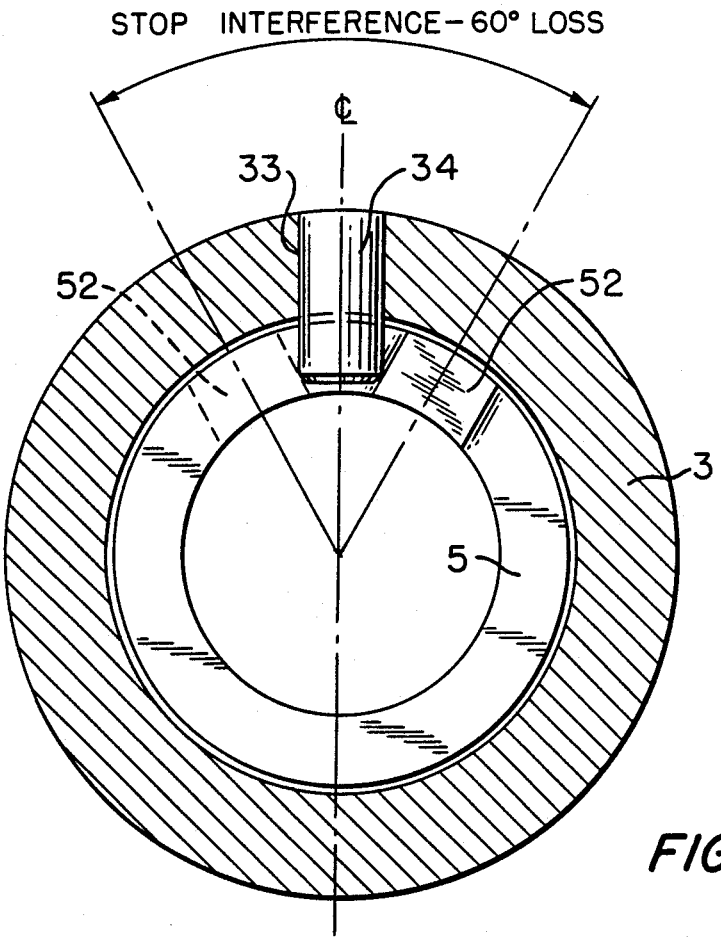
FIG. 7 is an enlarged top plan view of the assembly of the tubular adaptor and the rotatable tubular swivel shaft of the swivel device of the invention showing the maximum degree of rotation of the swivel shaft in solid lines in one position and in dashed lines in a rotated position.
Figure 8:
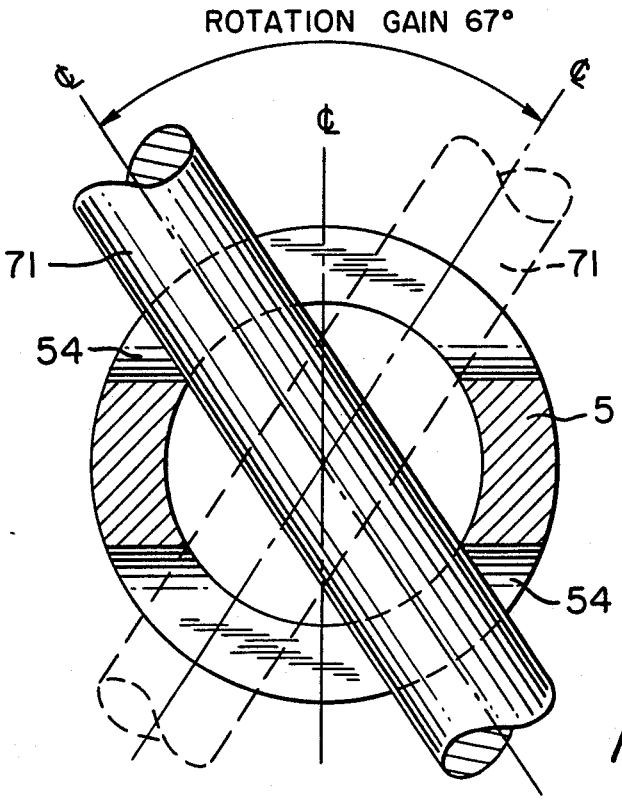
FIG. 8 is an enlarged top plan cross sectional view of the assembly of the rotatable tubular swivel shaft and the horizontal rod affixed to the horizontal rotatable knob of the swivel device of the invention showing the maximum degree of rotation gain of the swivel shaft about the horizontal rod in solid lines in one position and in dashed lines in a rotated position.

As shown in FIGS. 1A, 2 and 3, the vertical tubular stem 2 has an upper portion and a lower portion. The upper portion is rigidly affixed to the bracket 1 and the lower portion has male threads 21.

As shown in FIGS. 1A, 2, 4 and 7, the tubular adaptor 3 is beneath the stem 2 and has an upper portion, a lower portion and an intermediate portion. The upper portion has female threads 31 tightly engaged with the male threads 21 of the stem 2. A tight engagement, i.e., interlocking, of the mating threads can be obtained by use of a cement therebetween. The lower portion has an internal circular shoulder 32. The intermediate portion has a hole 33 bearing a rotation stop pin 34 which extends into the interior of the adaptor 3.

As shown in FIG. 1A, 2, 5A and 5B, the rotatable tubular bushing 4 is beneath both the stem 2 and the adaptor 3. The bushing 4 has an upper portion and a lower portion. The upper portion has an axially extending notch 41 while the lower portion has diametrically opposed holes 42, 42' in circular recesses 43, 43', respectively, one of which holes 42' is axially beneath the notch 41.

As shown in FIGS. 2, 6A, 6B, 6C, 7 and 8, the rotatable tubular swivel shaft 5 is inside both the adaptor 3 and the bushing 4. The swivel shaft 5 has an upper portion, a lower portion, an upper intermediate portion and a lower intermediate portion. The upper portion has an external circular flange 51 resting upon the internal circular shoulder 32 of the adaptor 3 and has an upwardly extending prong 52 engageable with the rotation stop pin 34 of the adaptor 3 upon rotation of the swivel shaft 5. The upper intermediate portion has a cutout 53 in alignment with the notch 41 of the bushing 4. The lower intermediate portion has diametrically opposed slots 54 in alignment with the diametrically opposed holes 42, 42' of the bushing 4. The lower portion has male threads 55 extending below the bushing 4.

As shown in FIGS. 1A, 1B and 2, the vertical rotatable knob 6, which preferably is knurled for ease of gripping with the fingers of a hand, has a hollow interior with female threads 61 engaged with the male threads 55 of the swivel shaft 5. This knob 6 is tightenable against the lower portion of the bushing 4 at its bottom and hence serves as an angular adjustment locking means.

The vertical tubular stem 2, tubular adaptor 3, rotatable tubular bushing 4, rotatable tubular swivel shaft 5 and vertical rotatable knob 6 have a common vertical axis.

As shown in FIGS. 1A, 1B, 2 and 8, the horizontal rotatable knob 7, which preferably is also knurled, has a rigidly affixed horizontal rod 71 with male threads 72. This rod 71 passes freely through and is rotatable in the diametrically opposed holes 42, 42' of the bushing 4 and passes freely through and is rotatable in the aligned diametrically opposed slots 54 of the swivel shaft 5. The knob 7 is tightenable against the lower portion of the bushing 4 in the circular recesses 43 of the bushing 4 and hence serves as an angular adjustment locking means.

As shown in FIGS. 1A, 1B and 2, the horizontal stem 8 has two ends, one of which has a hollow interior with female threads 81 engaged with the male threads 72 of the rod 71 rigidly affixed to the horizontal knob 7.

The horizontal rotatable knob and horizontal stem have a common horizontal axis.

As shown in FIGS. 1A, 1B and 2, the mounting ring 9 for the spotlight 91 is rigidly affixed to the other end of the horizontal stem 8 and preferably has a specular black paint finish on its interior surface.

The principal members of the swivel device are made of metal and, with the exception of the inner swivel shaft 5, their outer surfaces may have a paint finish to improve the aesthetic appearance of the swivel device.

The swivel device can be assembled in the following manner.

The rotatable tubular swivel shaft 5 is inserted downwardly through the center of the tubular adaptor 3 until the external circular flange 51 of the swivel shaft 5 rests upon the internal circular shoulder 32 of the adaptor 3. The rotation stop pin 34 is then inserted into the hole 33 in the intermediate portion of the tubular adaptor 3. The tubular adaptor 3 is then tightly threaded upon and preferably cemented to the vertical tubular stem 2 having the upper horizontal bracket 1 affixed thereto. The rotatable tubular bushing 4 is slid upwardly around the swivel shaft 5. The diametrically opposed slots 54 of the rotatable swivel shaft 5 are then aligned with the diametrically opposed holes 42, 42' of the rotatable bushing 4 while simultaneously aligning the cutout 53 of the swivel shaft 5 with the notch 41 of the bushing 4. The vertical rotatable knob 6 is then threaded upon the swivel shaft 5.

The electrical wires 15 for the spotlight 91 are passed through the axially extending notch 41 of the tubular bushing 4 and through the aligned cutout 53 of the tubular swivel shaft 5. These electrical wires 15 are then fed axially upwardly through the tubular bushing 4, the tubular swivel shaft 5, tubular adaptor 3, the tubular stem 2 and out through the central hole 14 of the bracket 1 for subsequent attachment to a source of electricity, such as the low voltage track 13.

Thereafter, the threaded horizontal rod 71 affixed to the horizontal knob 7 is passed through the diametrically opposed holes 42, 42' of the bushing 4 and through the aligned diametrically opposed slots 54 of the swivel shaft 5. The threaded horizontal stem 8 having the mounting ring 9 for the spotlight 91 affixed thereto is then threaded upon the threaded horizontal rod 71. The vertical and horizontal rotatable knobs 6, 7 are then tightened against their respective lower portions of the bushing 4.

The spotlight 91 with its parabolic reflector is then placed down into the mounting ring 9 and held in place on a ledge 92 thereof by the insertion of a split O-ring 93. A socket 94 affixed to the electrical wires 15 is then attached to the spotlight terminals 95.

The spotlight 91 can be adjustably rotated around a vertical axis and/or a horizontal axis to the desired composite arcuate or angular locations by the following procedure.

The adjustment of the spotlight 91 around a horizontal axis over an arc, such as 180°, is achieved by loosening the horizontal rotatable knob 7 away from the circular recess 43 in the lower portion of the bushing 4 and then rotating clockwise or counterclockwise the spotlight mounting ring 9 with its affixed horizontal stem 8 about the horizontal axis of the freely rotatable rod 71 to the desired vertical arcuate or angular location. The horizontal rotatable knob 7 is thereafter tightened against the circular recess 43 in the lower portion of the bushing 4 to fix or lock the desired vertical arcuate or angular location of the spotlight 91.

The spotlight 91 is adjustably rotated around a vertical axis to the desired horizontal arcuate location of more than 360° by the following procedure.

The vertical rotatable knob 6 is loosened away from the lower portion of the bushing 4. The mounting ring 9 for the spotlight 91 and its affixed horizontal stem 8 are rotated clockwise or counterclockwise together with the rotatable tubular bushing 4 and the rotatable tubular swivel shaft 5. The swivel shaft 5 can be rotated around the vertical axis through a horizontal arc of 300° from one side of the stop pin 34 housed in the tubular adaptor 3 to the other side of that stop pin 34, i.e., the upwardly extending prong 52 of the tubular swivel shaft 5 can be rotated from one side of the stop pin 34 around to the other side of the stop pin 34 of the tubular adaptor 3. Thus there is a stop interference loss of 60° from a complete 360° rotation (See FIG. 7). However, a rotational gain of 67° for a total arc rotation of 367° is achieved by movement of the rod 71 affixed to the horizontal knob 7 passing in a horizontal arc from one side of the opposed slots 54 to the other side of the opposed slots 54 in the swivel shaft 5 (See FIG. 8). The vertical rotatable knob 6 is thereafter tightened against the lower portion of the bushing 4 to fix or lock the desired horizontal arcuate or angular location of the spotlight 91.

From the foregoing description of the swivel device of the invention and its usage it will be readily seen that the swivel device not only permits adjustable rotation of the spotlight 91 around a horizontal axis over an arc, such as a 180°, but more importantly also permits adjustable rotation of the spotlight 91 around a vertical axis over a maximum arc of more than 360° without twisting damage to the electrical wires 15 passing through an interior portion of the swivel device.

The swivel device of the invention is also extremely compact and very neat and simple in appearance. Thus, the swivel device can be manufactured with all the vertical means, except for the inner swivel shaft 5, having a small common outer diameter of no more than ½ inch and both the horizontal rotatable knob 7 and the horizontal stem 8 having a smaller common outer diameter of no more than 5/16 inch. These two common outer diameters give the swivel device the attractive appearance of two plain intersecting rods with no visible hint from a distance that angular adjustment locking means exist.

What is claimed is:

1. A swivel device for mounting a spotlight which comprises vertical means for adjustable rotation of the spotlight around a vertical axis over a maximum arc of more than 360° without twisting damage to electrical wires passing through an interior portion of the vertical means, including a vertical tubular stem adapted to be non-rotatably affixed to a mounting bracket and a tubular vertical swivel assembly coaxial with and releasably coupled to the vertical tubular stem for rotation about the axis of the vertical stem through an arc of not less than 360°, the vertical stem and swivel assembly having a uniform external diameter throughout their extents, and horizontal means for adjustable rotation of the spotlight around a horizontal axis including a horizontal stem adapted to support the spotlight at one end and releasably attached at its other end to the vertical swivel assembly with its axis orthogonal to the axis of the swivel assembly for rotation about its own axis through an arc of not less than 180°.

2. A swivel device as defined by claim 1 wherein the vertical swivel assembly includes a tubular adaptor beneath and tightly threaded onto the stem, the adaptor having a rotation stop pin extending into an interior of the adaptor;

a rotatable tubular bushing beneath both the stem and the adaptor;

a rotatable tubular swivel shaft inside both the adaptor and the bushing and having an upwardly extending prong engageable with the rotation stop pin of the adaptor upon rotation of the swivel shaft; and a vertical rotatable knob threaded to the swivel shaft;

and the horizontal means further includes a horizontal rotatable knob having an affixed horizontal rod, the rod passing freely through and rotatable in diametrically opposed holes of the bushing and aligned diametrically opposed slots of the swivel shaft;

the horizontal stem having an end threaded to the rod affixed to the horizontal knob; and said horizontal rotatable knob and horizontal stem having a common horizontal axis.

3. A swivel device as defined by claim 2 wherein all the vertical means, except for the inner swivel shaft, have a small common outer diameter and both the horizontal rotatable knob and the horizontal stem having a smaller common outer diameter.

4. A swivel device as defined by claim 3 wherein all the vertical means, except for the inner swivel shaft, have a small common outer diameter of no more than ½ inch and both the horizontal rotatable knob and the horizontal stem having a smaller common outer diameter of no more than 5/16 inch.

5. A swivel device for mounting a spotlight which comprises an upper horizontal bracket;

a vertical tubular stem having an upper portion and a lower portion, the upper portion being rigidly affixed to the bracket and the lower portion having male threads;

a tubular adaptor beneath the stem and having an upper portion, a lower portion and an intermediate portion, the upper portion having female threads tightly engaged with the male threads of the stem; the lower portion having an internal circular shoulder; and the intermediate portion having a hole bearing a rotation stop pin extending into an interior of the adaptor;

a rotatable tubular bushing beneath both the stem and the adaptor and having an upper portion and a lower portion, the upper portion having an axially extending notch and the lower portion having diametrically opposed holes in circular recesses, one of which holes is axially beneath the notch;

a rotatable tubular swivel shaft inside, both the adaptor and the bushing and having an upper portion, a lower portion, an upper intermediate portion and a lower intermediate portion; the upper portion having an external circular flange resting upon the circular shoulder of the adaptor and having an upwardly extending prong engageable with the rotation stop pin of the adaptor upon rotation of the swivel shaft; the upper intermediate portion having a cutout in alignment with the notch of the bushing; the lower intermediate portion having diametrically opposed slots in alignment with the diametrically opposed holes of the bushing; and the lower portion having male threads extending below the bushing;

a vertical rotatable knob having a hollow interior with female threads engaged with the male threads of the swivel shaft; the knob being tightenable against the lower portion of the bushing;

a horizontal rotatable knob having a rigidly affixed horizontal rod with male threads, the rod passing freely through and rotatable in the diametrically opposed holes of the bushing and passing freely through and rotatable in the aligned diametrically opposed slots of the swivel shaft; the knob being tightenable against the lower portion of the bushing in one of the circular recesses of the bushing;

a horizontal stem having two ends, one end having a hollow interior with female threads engaged with the male threads of the rod rigidly affixed to the horizontal knob; and a spotlight rigidly affixed to the other end of the horizontal stem;

said vertical tubular stem, tubular adaptor, rotatable tubular bushing, rotatable tubular swivel shaft and vertical rotatable knob having a common vertical axis and said horizontal rotatable knob and horizontal stem having a common horizontal axis.

6. A swivel device as defined by claim 5 wherein the vertical tubular stem, the tubular adaptor, the rotatable tubular bushing and the vertical rotatable knob have a small common outer diameter and both the horizontal rotatable knob and the horizontal stem have a smaller common outer diameter.

7. A swivel device as defined by claim 6 wherein the vertical tubular stem, the tubular adaptor, the rotatable tubular bushing and the vertical rotatable knob have a small common outer diameter of no more than $\frac{1}{2}$ inch and both the horizontal rotatable knob and the horizontal stem have a smaller common outer diameter of no more than 5/16 inch.

* * * * *